United States Patent [19]

Warheit

[11] Patent Number: 5,060,543

[45] Date of Patent: Oct. 29, 1991

[54] SELF-ADJUSTING TOOL

[76] Inventor: William A. Warheit, 121 Iroquois Dr., Butler, Pa. 16001

[21] Appl. No.: 472,516

[22] Filed: Jan. 30, 1990

[51] Int. Cl.[5] ..... B25B 7/04

[52] U.S. Cl. ..... 81/409; 81/321; 81/361; 81/411

[58] Field of Search ..... 81/318–321, 81/324, 358, 361, 407–414

[56] References Cited

U.S. PATENT DOCUMENTS

| | | | |
|---|---|---|---|
| 1,106,518 | 8/1914 | Matti | 81/320 |
| 1,534,218 | 4/1925 | Jones | 81/320 |
| 2,066,716 | 1/1937 | Cruickshank | 81/411 |
| 2,587,263 | 2/1952 | Wortelmann | 81/408 X |
| 3,005,368 | 10/1961 | Johnson | 81/409.5 |
| 4,304,158 | 12/1981 | Brunosson et al. | 81/427.5 |
| 4,651,598 | 3/1987 | Warheit | 81/407 |
| 4,662,252 | 5/1987 | Warheit | 81/341 |
| 4,802,390 | 2/1989 | Warheit | 81/341 |
| 4,893,530 | 1/1990 | Warheit | 81/409.5 |

*Primary Examiner*—James G. Smith

*Attorney, Agent, or Firm*—Reed Smith Shaw & McClay

[57] ABSTRACT

A self-adjusting tool having first and second elongated members, each of which have a workend and an oppositely located handle means for applying force to the tool. The first member includes a raceway positioned intermediate of the work end and handle. A connector is provided adjacent to the work ends for slideably and pivotally connecting the first and second members together. The connector includes an elongated slot in the first member having ratchet teeth along at least a portion of one edge thereof and a pawl positioned to slide within the slot and to pivotally engage the ratchet teeth. A fastener for securing the first and second members slideably together and securing the pawl in the slot is provided as part of the connector. A torsion arm with first and second ends is operably positioned between the first and second members. The first end includes a torsion element connected to the second member and the second end is slideably positioned within the raceway. The torsion arm is of sufficient length to space the work ends away form each other to their maximum extent when no force is applied to the handles. An initial restraining member is positioned within said raceway to initially restrain movement of the torsion arm therein.

10 Claims, 4 Drawing Sheets

SELF-ADJUSTING TOOL

FIELD OF THE INVENTION

The present invention is an improvement in self-adjusting tools and, in particular, to a self-adjusting tool having a positive engagement means for facilitating the use of the tool in any position and including releasable locking means for maintaining positive engagement without manual pressure.

BACKGROUND OF THE INVENTION

The invention is an improvement in self-adjusting plier-type tools known in the prior art. In particular, the invention is an improvement in the self-adjusting tools shown and described in U.S. Pat. Nos. 4,651,598, 4,662,252, 4,802,390 and 4,893,530. The former patents disclose self-adjusting utility pliers which provide for the automatic sliding of the upper and lower workend to pivotally grip a workpiece as manual pressure is exerted on the handles of the tool.

U.S. Pat. No. 4,893,530 comprises an improvement in plier-type tools over those disclosed in the former patents. The improvements included a manually releasable locking feature for retaining the workjaws in a locked position on a workpiece. The improvement also included an enhanced pawl for permitting positive engagement thereof upon contact of a workpiece by the workjaws of the tool.

The present invention is an improvement over the self-adjusting plier shown and described in U.S. Pat. No. 4,893,53O, which is herein incorporated by reference.

SUMMARY OF THE INVENTION

Generally, the present invention comprises a self-adjusting tool having first and second elongated members each having a workend adapted to come into contact with a workend of the other member to grip a workpiece. At the opposite end of each of the elongated members is a handle means. The first member includes a raceway along a portion of its length adjacent to the handle means; and, in a preferred embodiment, includes a raceway cover.

A connector means is provided adjacent the workends for slideably and pivotally connecting the first and second elongated members together. The connector means includes in the first member an elongated slot having engaging means along at least a portion of one edge of the slot. An engagement member is included and positioned within the slot for engagement with the engagement means. A means for securing the engagement member within the slot and positioned between the first and second members. The securing means also secures the first and second members in slideable and pivotable relationship to each other.

The tool includes a torsion arm having first and second ends. Integrated with the first end is a torsion means pivotally connected to the second elongated member. In a preferred embodiment, the torsion means is positioned within a substantially circular opening in the first end of the torsion arm. The second end is slideably positioned within the raceway of the first elongated member.

In a preferred embodiment of the invention, an initial restraining means is positioned within the raceway to restrain initial movement of the torsion arm within the raceway. The restraint means can include a detent or a biasing spring or a like means to assist engagement member to engage the engagement means upon contact by the workends with a workpiece. In normal application of the tool, it is generally not necessary to have an initial restraining means; but, when using the tool in an inverted position, it has been found desirable to include such means to prevent the engagement member from binding in the slot or failing to engage the engagement means.

In another embodiment of the invention, a ratchet member is included in the raceway and a pivotable locking means is pivotally secured to the second end of the torsion arm and engagable in said ratchet member. As the second end of the torsion arm overcomes the initial restraint means and slides along the raceway, the locking means slides engagably along the ratchet means and engages the teeth of the ratchet upon full adjustment of the workend of the tool on the workpiece. To secure the locking means within the ratchet member, it is desirable that the second elongated member act as a flex beam. Alternatively, a neoprene or like means can be used in the securing means to provide the desired flex. This locking means thus maintains the grip of the workends on the workpiece until pivoted out of the ratchet by manual force applied in the opposite direction to disengage the workend.

In a preferred embodiment, the initial restraint means includes a compression spring. When a locking means is used, the compression spring can perform the second function of biasing the locking means into the teeth of the ratchet member. This embodiment facilitates one-handed operation of the tool. Additionally, the invention provides minimal cavity openings to prevent the accumulation of dirt that would inhibit the smooth operation of the tool.

Other advantages of the invention will become apparent from a perusal of the following detailed description of presently preferred embodiments of the invention taken in connection with the accompanying drawings.

PRESENTLY PREFERRED EMBODIMENTS

Figure 1:
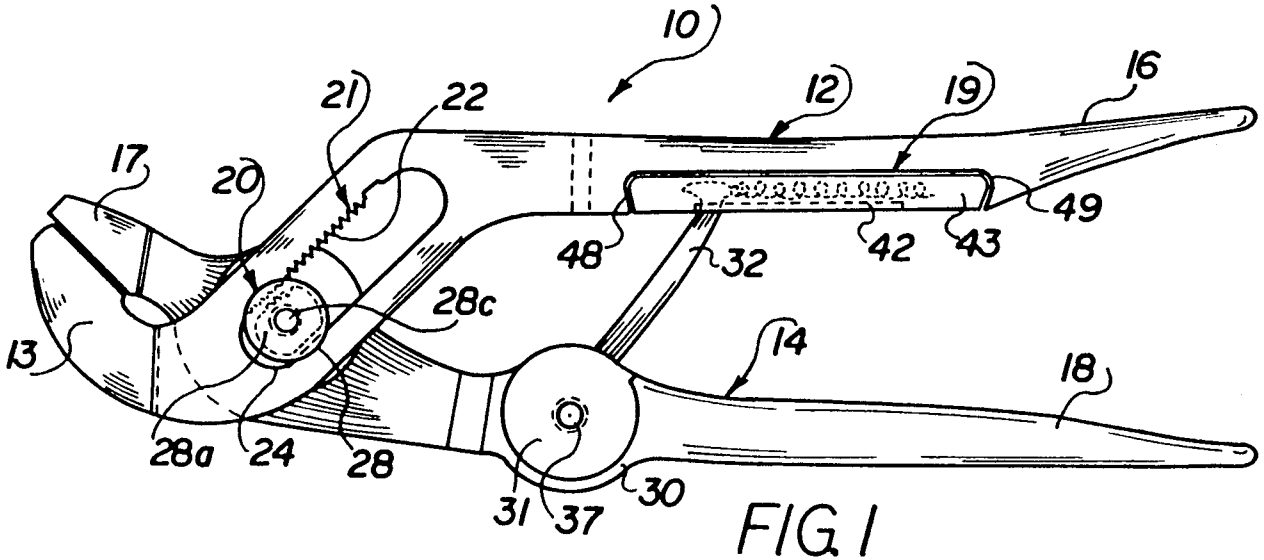
FIG. 1 is an elevation of the self-adjusting tool in a closed position.
Figure 2:
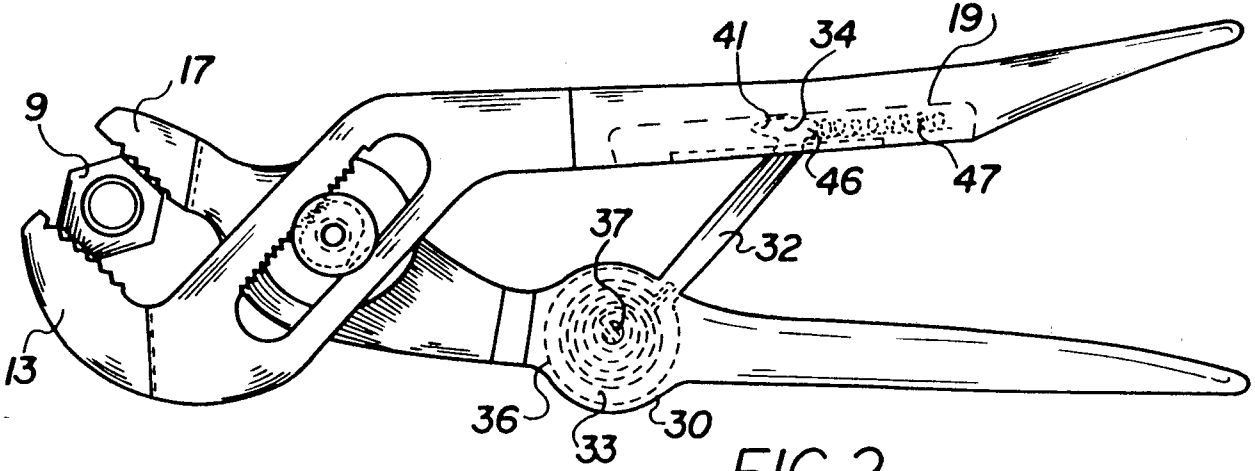
FIG. 2 is an elevation of the self-adjusting tool showing the workends gripping a workpiece.

Referring to FIGS. 1 and 2, self-adjusting tool 10 includes first and second elongated members 12 and 14, respectively. First elongated member 12 includes a workend 13 and a handle end 16 located at the opposite end thereof. Second elongated member 14 includes a workend 17 and a handle end 18. Workends 13 and 17 can be specially configured for particular applications. For example, in the conventional plier-type tool the workends would include jaws for gripping a workpiece. The workend may be adjustable or adapted for replaceable end pieces. Accordingly, the tool of the present invention can be designed and used for varying applications.

First elongated member 12 includes adjacent its handle a raceway 19. Raceway 19 may include a cover, described below, to include an initial restraining means and a locking member.

Figure 3:
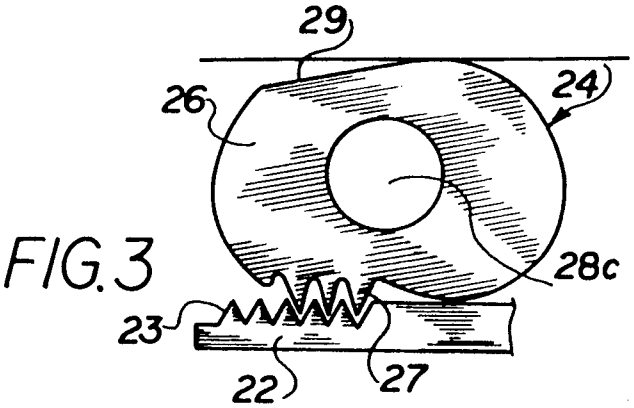
FIG. 3 is an enlarged view of the engagement means and engagement member.

Connector means 20 is located adjacent to workends 13 and 17 of first and second elongated members 12 and 14, respectively. Connector means 20 includes elongated slot 21 positioned in first member 12. Elongated slot 21 includes engagement means 22 in the form of ratchet teeth 23 (shown more clearly in FIG. 3). Engagement member 24 preferably includes a pawl 26 having teeth 27 engagable in teeth 23 of engagement means 22. Securing means 28 extends through engagement member 24 and compresses first and second members together to pivotally secure engagement member 24 within slot 22. Preferably, securing means 28 is a bolt means having a substantially flat head 28(*a*) which rides on the outside of first member 12 and a nut means 28(*b*) which is secured against second member 14. Shaft 28(*c*) passes through and permits pawl 26 to rotate about the shaft.

The operation of engagement member 24 and engaging means 21 are set forth more fully in U.S. Pat. No. 4,893,530. Generally, when the workends are moved together, engagement member 24 slides within slot 21. However, when a workpiece is engaged by workends 13 and 17, there is a lateral shifting of second elongated member 14 a slight distance relative to slot 21. This lateral shifting causes pawl 26 to rotate slightly around securing means 28 such that teeth 27 engage ratchet teeth 23 as shown more clearly in FIG. 3. When pressure on the handles is released such that the normal biasing of the workends to an open position, pawl 26 rotates so that flat end 29 rides along slot 21 disengaging teeth 27 from ratchet teeth 23.

Referring to FIG. 2, second member 14 preferably includes a recess 30 of generally circular configuration having a cover 31 completely covering the recess. Positioned within recess 30 is a torsion means of torsion arm 32. Torsion arm 32 has a first end 33 which includes a torsion means 36 and a second end 34. Torsion means 36 is preferably a torsion spring having one end thereof secured to torsion arm 32 and a second end fixed within pin 37 securely mounted to second elongated member 14. Torsion means 36 biases torsion arm 32 and its second end 34 towards the work ends of the elongated members so that in their normal position workends 13 and 17 are open and spaced apart from each other the maximum extend of the tool.

Second end 34 of torsion member 32 rides in raceway 19 of first member 12. Second end 34 includes a lip portion 41 for engaging the slot 42 of raceway cover 43. Because of the biasing forward of torsion arm 32 lip 41 prevents disengagement of arm 32 from raceway cover 43, described below. Second end 34 also includes a rear abutment flange 46 adapted to engage retaining means 47.

As shown in FIGS. 1 and 2, raceway 19 includes raceway cover 43 which is preferably keyed so as to slide into engagement with mating surfaces 48 and 49 of first elongated member 12. By providing recessed mating surfaces 48 and 49, cover 43 is securely positioned within member 12. Slot 42 provides an opening in which torsion arm 32 can slide within raceway 19.

As shown in FIGS. 1 and 2, initial restraining means 47 preferably comprises a pair of springs, one fitted within the other and one having a reverse helix. Initial restraint means 47 provides enough bias on flange 46 of torsion arm 32 to prevent its movement until a workpiece 9 is engaged by workends 13 and 17. While a single compression spring having the same force may be used, it has been found that the life of such springs is generally not sufficient to provide a long service life, i.e., they are subject to fatigue. Accordingly, it is preferred that a pair of reverse helix springs be used, one inside of the other.

This initial restraining force assures that teeth 27 of pawl 26 firmly engage teeth 23 of ratchet 22. Continued application of force on handles 16 and 18 urging them together causes torsion arm 32 to overcome the initial restraining force and move along raceway 19. Other methods of providing initial restraint are shown in FIGS. 4 and 5.

Figure 4:
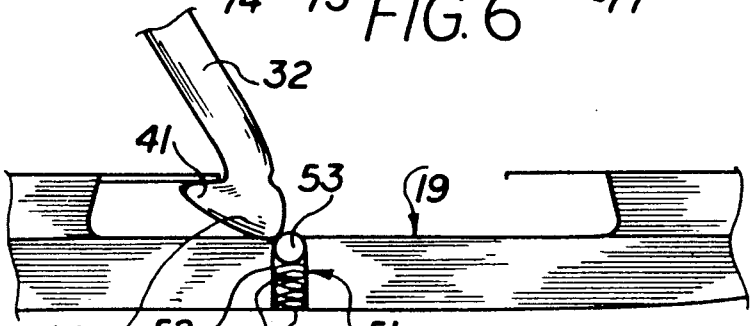
FIG. 4 is an enlarged view of the raceway of the present invention showing a detent as the initial restraining means.

Referring to FIG. 4, raceway 19 is provided with a small detent 51 comprising a cylindrical opening 52 in elongated member 12 extending through to the surface of raceway 19. At the surface of the raceway, the opening is preferably smaller in diameter than opening 52. Positioned at the surface is a small ball 53 biased to the surface of raceway 19 by means of spring 54. Ball 53 preferably has a diameter slightly smaller than opening 53, and larger than the opening of 52 at the surface of raceway 19. Spring 54 is maintained in opening 52 by means of cap 56 screwed into the bottom of member 12. Ball 53 makes contact with flange 46 of torsion arm 32 to provide the initial restraint desired.

Figure 5:
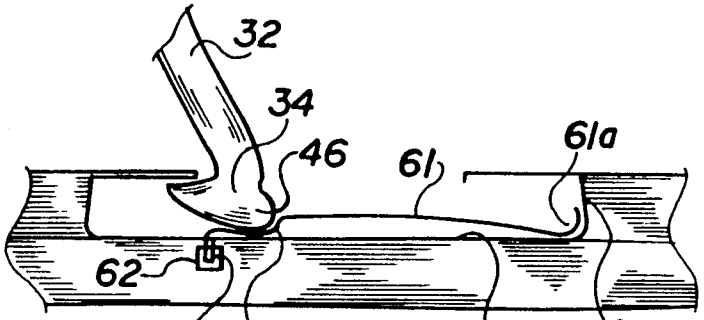
FIG. 5 is an enlarged view of the raceway showing another embodiment of the initial restraint means.

Alternatively, as shown in FIG. 5, a flat spring 61 is positioned along and substantially parallel to raceway 19 having one of it ends juxtapositioned to edge 49 and the other end fixed into a small slot 62 located in the surface of raceway 19. Detent 63 is formed in spring 61 to provide initial restraint against the rearward movement of end 34 of torsion arm 32. Other methods of providing initial restraint may be used.

It has been found desirable to include initial restraint means in order to assist engagement of teeth 27 of pawl 26 into the teeth of ratchet 23 of engagement means 22. This is normally the case when the tool is used in an inverted position; i.e., when workends 13 and 17 are downwardly positioned. Initial restraining means 47 prevents any binding of the engagement member 24 along slot 21 or failure to engage teeth 23.

Figure 6:
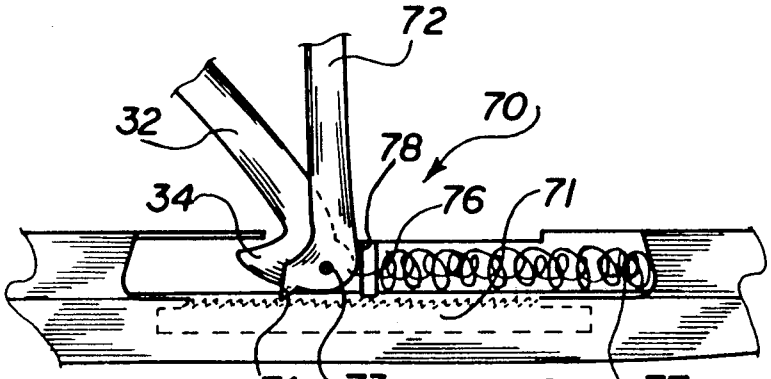
FIG. 6 is an enlarged view of a preferred embodiment of the raceway showing a ratchet means and locking member.

In certain applications, it is desirable once workends 13 and 17 have engaged workpiece 9 to lock them in position. Referring to FIG. 6, a preferred locking means 70 for such application is shown. Positioned adjacent raceway 19 is a ratchet means 71 having teeth thereon. Teeth 71 may be formed as part of the raceway or as a separate insert as shown in FIG. 6. A locking means 70 includes a locking arm 72 which is pivotally secured to torsion arm 32 at second end 34 by pivot means 73. Locking arm 72 includes engaging means 74 adapted to engage the teeth of ratchet means 71. Locking arm 72 includes an arcuate portion 76 adapted to engage biasing means 77 comprising a helical spring which also function as initial restraining means. In the embodiment shown in FIG. 6, it is desirable to include backer means 78 adapted to make contact with arcuate portion 76 of locking member 72. Biasing means 77 exerts through backing means 78 a force on arm 72 so as to rotate said arm and its engagement tooth 74 into engagement with a tooth 71 of the ratchet means. Accordingly, it is necessary that arcuate portion 76 of locking arm 72 contact biasing means 77 prior to end 46 of torsion arm 32. In this way, biasing means 77 may function both as the initial restraining means and as a functional element of locking member 70.

In operation, biasing member 77 forces arm 72 in counterclockwise direction engaging teeth 71 and 74 of the ratchet and locking arm, respectively. To disengage the locking means, arm 72 is moved in a clockwise direction to disengage teeth 71 and 74. Locking arm 72 preferably extends towards elongated member 14 so that engagement and disengagement can be triggered by one hand while gripping the handles of the tool.

Figure 7:
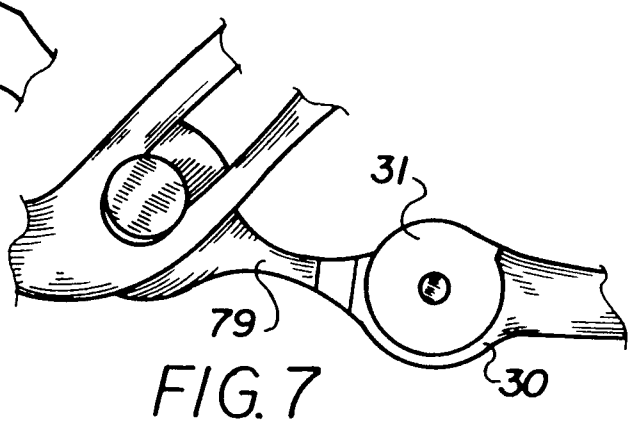
FIG. 7 is an enlarged view of a preferred embodiment of the second elongated member configured as a flex beam for use in the embodiment shown in FIG. 6.

To assure that engagement tooth 74 properly engages teeth 71 and remain locked, it is desirable that second member 18 be provided with a narrowed segment 79 as shown in FIG. 7. Narrowing segment 79 renders second member 18 the equivalent of a flex beam. Accordingly, other means may be used to achieve the same result. For example, a neoprene washer can be positioned adjacent to head 28(*a*).

Figure 8:
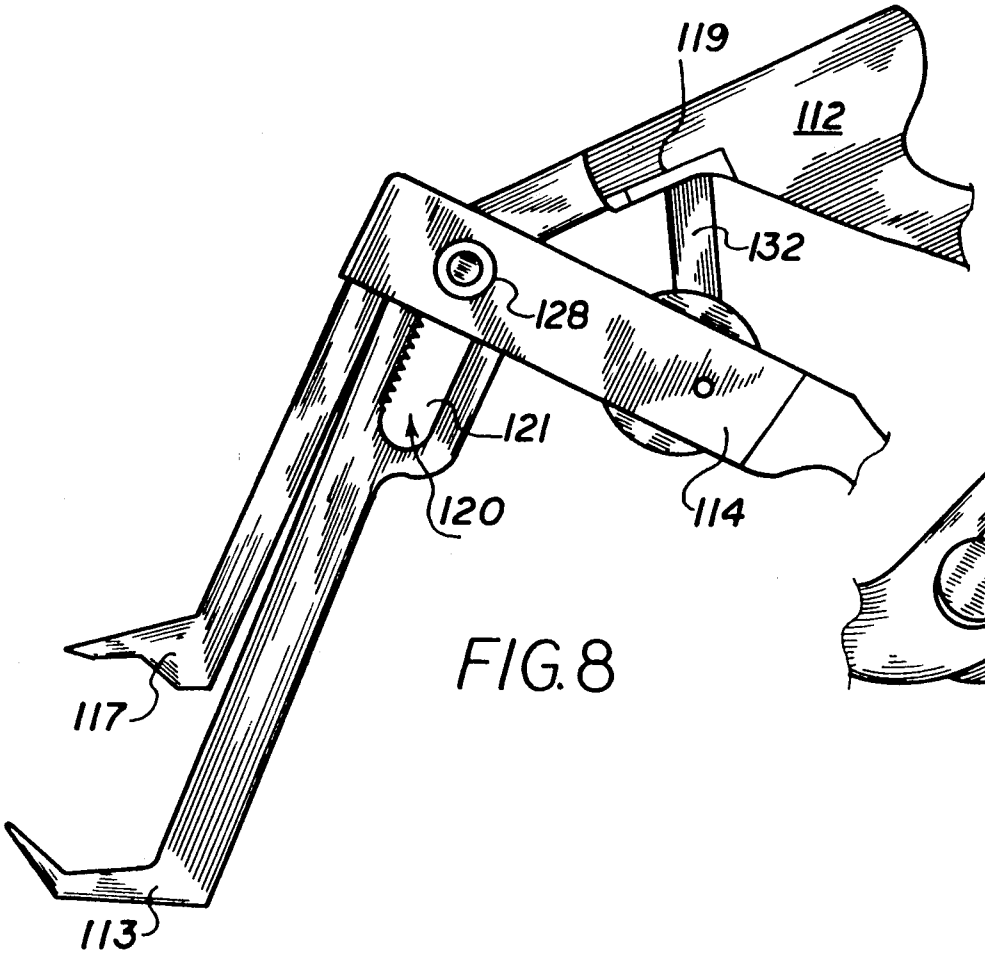
FIG. 8 is another embodiment of the self-adjusting tool for medical application.

In addition to plier-like configuration, self-adjusting tool 10 can be used for many applications. As shown in FIG. 8, elongated workend 113 and 117 make the tool useful for medical applications. Hence, in this case first and second elongated members 112 and 114 include elongated workends 113 and 117, respectively. Elongated workends permit the workends to extend beyond the main body of the tool. This is particularly useful, for example, for gripping broken bones of a patient. The bone can be grasped without interference from the handles or torsion arm of the tool. As shown in FIG. 8, torsion arm 132 rides in raceway 119. Connector means 120 includes a slot 121 in first elongated member 119 and has an engagement member secured by securing means 128. In all other respects, the tool is the same as described above with regard to FIGS. 1 and 2.

As will be readily apparent to those skilled in the art, the present invention provides a tool which is simpler and less expensive to manufacture then prior art tools of like type. The present invention may be made by casting, forging or stamping. Also, elongated members may include an elastoneric covering to provide a better grip and to further minimize the number of openings or cavities in which dirt may accumulate. While presently preferred embodiments of the invention have been shown and described in particularity, the invention may be otherwise embodied within the scope of the appended claims.

I claim:

1. A self-adjusting tool comprising:

a. first and second elongated members, each of said members having a workend and at opposite ends therefrom handle means for applying force to said member, said first member having a raceway along a portion thereof and positioned adjacent said handle means;

b. connector means adjacent said workends for slideably and pivotally connecting said first and second members together, said connector means including an elongated slot in said first member, said slot including engaging means along at least a portion of one edge and an engagement member slideable within said slot and adapted to pivotally engage said engaging means, and means for securing said first and second members together and securing said engagement member in said slot;

c. a torsion arm with first and second ends, said first end including torsion means connected to said second member and said second end being slideably positioned within said raceway, said torsion arm being of length so as to space said work ends away from each other to their maximum extent when no force is applied to said handle means; and d. restraining means positioned within said raceway to initially restrain movement of said torsion arm therein, said restraining means comprising a first compression spring and a second compression spring positioned within said first spring but having a reverse helix.

2. A self-adjusting tool comprising:

a. first and second elongated members, each of said members having a workend and at opposite ends therefrom handle means for applying force to said member, said first member having a raceway along a portion thereof and positioned adjacent said handle means;

b. connector means adjacent said workends for slideably and pivotally connecting said first and second members together, said connector means including an elongated slot in said first member, said slot including engaging means along at least a portion of one edge and an engagement member slideable within said slot and adapted to pivotally engage said engaging means, and means for securing said first and second members together and securing said engagement member in said slot;

c. a torsion arm with first and second ends, said first end including torsion means connected to said second member and said second end being slideably positioned within said raceway, said torsion arm being of length so as to space said work ends away from each other to their maximum extent when no force is applied to said handle means; and d. restraining means positioned within said raceway to initially restrain movement of said torsion arm therein, said restraining means comprising a detent positioned within said raceway to abut said torsion arm when no force is applied to said handle means.

3. A self-adjusting tool as set forth in claim 2, wherein said detent comprises a ball moveably projectable through an opening in said raceway to make contact with said torsion arm.

4. A self-adjusting tool as set forth in claim 3 including a means for biasing said ball into said opening.

5. A self-adjusting tool as set forth in claim 1 or 2 including locking means for locking said workends to a workpiece and having ratchet teeth positioned in said raceway and a release arm pivotally mounted to said torsion arm and moveably engagable with said ratchet teeth.

6. A self-adjusting tool as set forth in claim 1 or 2, including locking means for locking said workends to a workpiece and having ratchet teeth positioned in said raceway, a release arm pivotally mounted to said torsion arm and moveably engagable with said ratchet teeth and biasing means for biasing said release arm into engagement with said ratchet teeth.

7. A self-adjusting tool as set forth in claim 5 wherein said second elongated member comprises a flex beam.

8. A self-adjusting tool as set forth in claim 5 wherein said securing means includes a means to permit said second elongated member to flex.

9. A self-adjusting tool comprising:

a. first and second elongated members, each of said members having a workend and at opposite ends therefrom handle means for applying force to said member, said first member having a raceway along a portion thereof and positioned adjacent said handle means;

b. connector means adjacent said workends for slideably and pivotally connecting said first and second members together, said connector means including an elongated slot in said first member, said slot including engaging means along at least a portion of one edge and an engagement member slideable within said slot and adapted to pivotally engage said engaging means, and means for securing said first and second members together and securing said engagement member in said slot;

c. a torsion arm with first and second ends, said first end including torsion means connected to said second member and said second end being slideably positioned within said raceway, said torsion arm being of length so as to space said work ends away from each other to their maximum extent when no force is applied to said handle means;

d. restraining means positioned within said raceway to initially restrain movement of said torsion arm therein; and e. locking means for locking said workends to a workpiece and having ratchet teeth positioned in said raceway and a release arm pivotally mounted to said torsion arm and moveably engagable with said ratchet teeth.

10. A self-adjusting tool comprising:

a. first and second elongated members, each of said members having a workend and at opposite ends therefrom handle means for applying force to said member, said first member having a raceway along a portion thereof and positioned adjacent said handle means;

b. connector means adjacent said workends for slideably and pivotally connecting said first and second members together, said connector means including an elongated slot in said first member, said slot including engaging means along at least a portion of one edge and an engagement member slideable within said slot and adapted to pivotally engage said engaging means, and means for securing said first and second members together and securing said engagement member in said slot;

c. a torsion arm with first and second ends, said first end including torsion means connected to said second member and said second end being slideably positioned within said raceway, said torsion arm being of length so as to space said work ends away from each other to their maximum extent when no force is applied to said handle means;

d. restraining means positioned within said raceway to initially restrain movement of said torsion arm therein; and e. locking means for locking said workends to a workpiece and having ratchet teeth positioned in said raceway, a release arm pivotally mounted to said torsion arm and moveably engagable with said ratchet teeth and biasing means for biasing said release arm into engagement with said ratchet teeth.

* * * * *